United States Patent [19]

Carpentier

[11] 4,042,983

[45] Aug. 23, 1977

[54] DRAIN ASSEMBLY FOR SINKS AND THE LIKE

[75] Inventor: John H. Carpentier, Fort Atkinson, Wis.

[73] Assignee: Beatrice Foods Co., Chicago, Ill.

[21] Appl. No.: 690,149

[22] Filed: May 26, 1976

[51] Int. Cl.[2] ..... E03C 1/122

[52] U.S. Cl. ..... 4/291; 210/163; 220/353

[58] Field of Search ..... 210/163–165; 220/356, 319, 320, 353; 4/291–293

[56] References Cited

U.S. PATENT DOCUMENTS

| | | | |
|---|---|---|---|
| 3,232,548 | 2/1966 | Bent | 242/58.1 |
| 3,305,189 | 2/1967 | Butler | 242/58.1 |
| 3,348,725 | 10/1967 | Fuller et al. | 220/356 |
| 3,450,299 | 6/1969 | Barbera | 220/353 |
| 3,515,417 | 6/1970 | Bowman | 16/2 |
| 3,516,617 | 6/1970 | Haner | 242/58.2 |
| 3,562,847 | 2/1971 | Jemison | 16/2 |
| 3,663,806 | 5/1972 | Drankham | 242/57 |
| 3,738,587 | 6/1973 | Cristiani | 242/58.1 |
| 3,742,525 | 7/1973 | Oropallo | 4/292 |
| 3,746,272 | 7/1973 | Rotolo | 242/58.3 |
| 3,858,819 | 1/1975 | Butler | 242/58.3 |

*Primary Examiner*—Robert I. Smith

*Attorney, Agent, or Firm*—Haven E. Simmons; James C. Nemmers

[57] ABSTRACT

A drain assembly for a sink or the like employs a plastic sleeve below a retaining flange, the periphery of the sleeve being provided with several groups of flexible fins extending out therefrom parallel to its axis, the fins of each group being located at successively increasing distances from the retaining flange. The assembly can be installed by one person from above the sink or the like simply by pushing it down into the drain aperture with a twisting motion until at least some of the fins in each group tightly engage the under surface of the drain aperture, the fins thereby readily accommodating both stainless steel and cast iron sinks or the like of various wall thicknesses.

15 Claims, 8 Drawing Figures

FIG 4
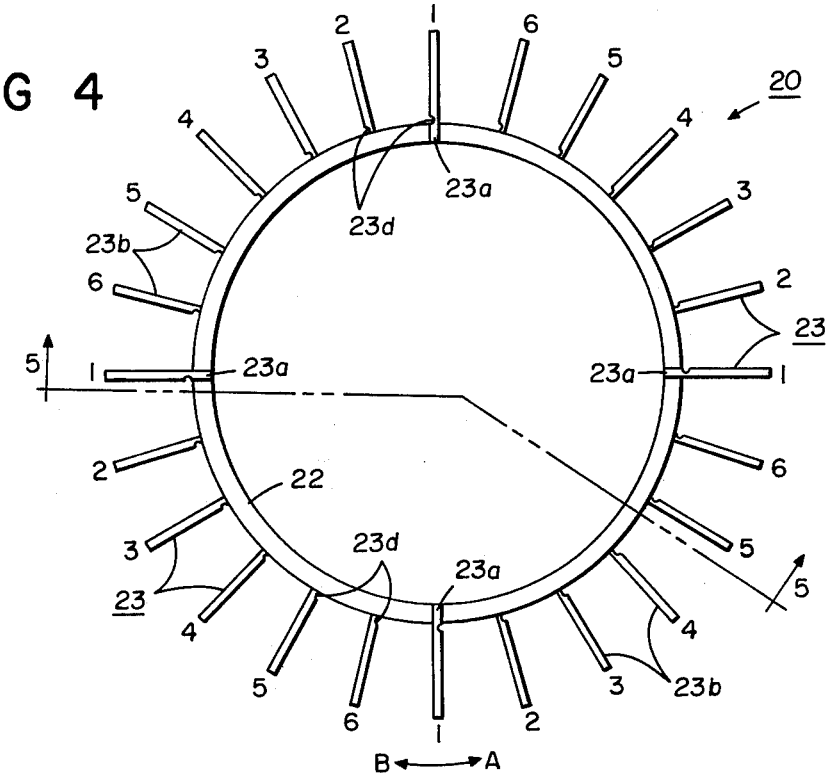
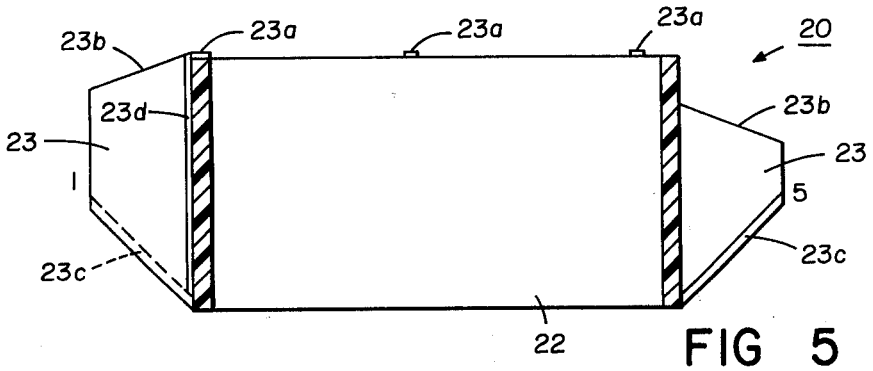
FIG 5
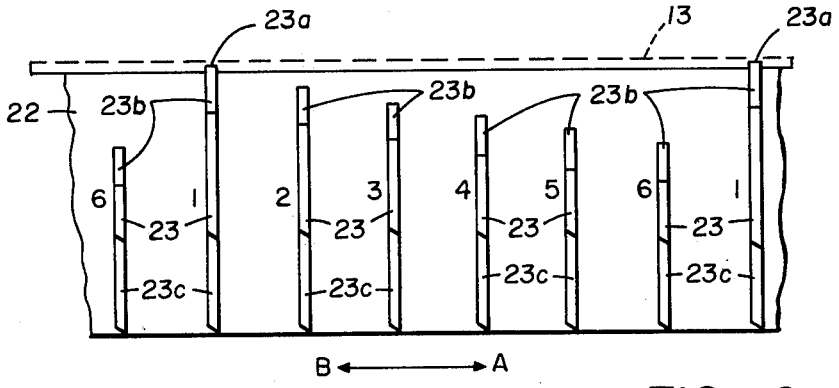
FIG 6

DRAIN ASSEMBLY FOR SINKS AND THE LIKE

BACKGROUND OF THE INVENTION

As is well known, the installation of a typical drain assembly in a sink or the like is a cumbersome operation for one man. He must insert the assembly from above the sink and hold it while it is secured, as by a ring nut or the like, from below the sink. All this, besides requiring not a little manual dexterity, consumes considerable time, ten to twelve minutes not being unusual in many instances.

Since the cost of labor is an increasingly large part of building expense, anything which reduces the time necessary for various equipment installations reduces that cost. This is true even in so mundane an installation as that of drain assemblies, especially in larger projects in which many such assemblies must be installed. It is thus the primary object of the present invention to provide a drain assembly which can be installed by one man alone from above a sink in a small fraction of the time now required and which simultaneously accommodates sinks or the like of various wall thicknesses.

SUMMARY OF THE INVENTION

The object of the present invention is achieved by eliminating the typical ring nut or other clamping mechanism and replacing it with a unique retaining sleeve. The body of the drain assembly, in a preferred form, is deep drawn from a single piece of stainless steel to provide a retaining flange at its upper end which seats in the usual manner against the upper face of the sink bottom wall around the drain aperture. The lower end of the body is formed for connection to the drain pipe while between the latter and the retaining flange is provided a circular well into which fits a typical basket-stopper. Over the exterior of the well is slipped the retaining sleeve of the present invention, which at one end abuts the retaining flange and is secured by a locking ring abutting its other end. From the outer periphery of the sleeve extends a number of fins generally parallel to the sleeve axis and resiliently flexible in both first and second circumferential directions relative to the sleeve body. In a preferred version, the sleeve and the fins are a one-piece injection molding. The fins are divided into several sets or groups of equal numbers of fins, the groups being uniformly disposed about the sleeve body. Each group of fins is provided with two sets of opposite side edges. The first set are "retaining edges" which oppose the retaining flange, the retaining edges of successive fins of each group taken in the first circumferential direction about the sleeve body being located at increasingly greater distances from the retaining flange and inclined away from the latter. The second set of side edges are "installing edges" which are all uniformly distant from the retaining flange and are inclined toward it as well as being transversely beveled toward the second circumferential direction about the sleeve body. The under face of the retaining flange is provided with an annulus of seal material, such as plumber's putty, which may be protected by a strippable film covering until ready for use.

The foregoing parts are pre-assembled by the manufacturer in the manner just described and furnished as a unitary assembly for installation in the field. For the latter purpose the workman merely removes the protective covering, pushes the assembly, lower end first, down into the drain aperture with a twisting action in the second circumferential direction referred to. The "installing edges" of the fins first engage the drain aperture and cause all the fins to flex circumferentially enough so that the assembly slips down through the drain aperture. Then some of the fins in each group snap back out again to varying extents, depending upon the thickness of the sink bottom wall, until their retaining edges contact the under side of the drain aperture. If the sink is stainless steel, for example, and thus relatively thin, the fins of each group whose retaining edges are furthest from the retaining flange will return fully to their normal position since they will be too far away to engage the sink bottom wall. But those fins whose retaining edges are progressively closer to the retaining flange will engage the sink bottom wall and remain in various states of flex with their retaining edges tightly engaged with the sink bottom wall, thus clamping the latter between the retaining edges and the body flange. If the sink is cast iron, on the other hand, and so thicker, only the retaining edges of those fins of each group which are further from the retaining flange will engage the sink bottom wall and clamp the drain assembly while the other fins will remain fully flexed against the wall of the drain aperture. The drain assembly of the present invention thereby automatically adjusts itself to sink walls of varying thickness, and can be completely and permanently installed in but a few seconds.

Other features and advantages of the drain assembly of the present invention will become apparent from the drawings and from the more detailed description which follows.

BRIEF DESCRIPTION OF THE DRAWINGS

FIG. 4 is a top plan view of the retaining sleeve of the present invention.

FIG. 5 is a sectional view along the line 5—5 of FIG. 4.

FIG. 6 is a side elevation of one group of fins of the retaining sleeve of FIG. 4 showing the fin pattern of the group in flat.

DETAILED DESCRIPTION OF THE PREFERRED EMBODIMENT

Figure 1:
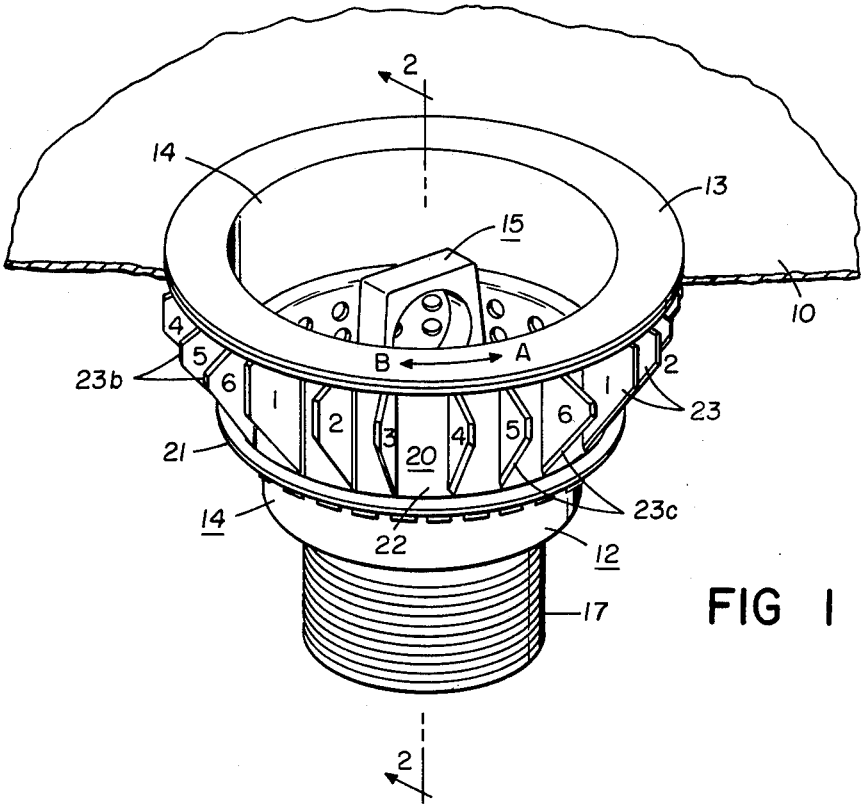
FIG. 1 is an isometric view of the drain assembly according to the present invention shown installed in a typical stainless steel sink, a portion of the bottom wall of the latter being broken away.
Figure 2:
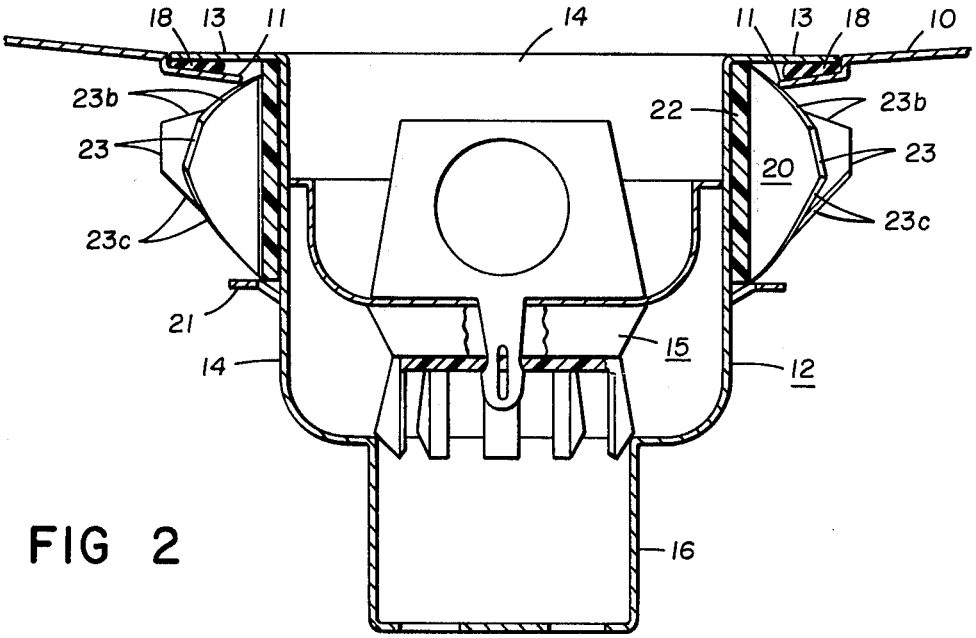
FIG. 2 is an axial section through the installation shown in FIG. 1 taken generally along the line 2—2 of that Figure.

In FIGS. 1 and 2 the bottom wall of a typical stainless steel sink (or any other of relatively thin wall) is designated at 10 and its drain aperture at 11. As mentioned, the drain assembly of the present invention consists of a drain body, generally designated at 12, deep drawn from suitable stainless steel to provide a retaining flange 13 at its upper end, an annular well 14 (into which fits a typical basket-stopper assembly 15), and a necked-down, lower drain end 16 provided with rolled threads 17 for connection to a drain pipe (not shown). When installed in the drain aperture 11 (see FIG. 2), a ring of seal material 18 between the retaining flange 13 and the area surrounding the drain aperture 11 seals the joint between the two. The outer surface of the body well 14 tightly receives a drain assembly retaining sleeve, generally designated at 20, having its upper end abutting the underface of the retaining flange 13 and located on the body well 14 by a locking ring 21 of the Tinnerman type abutting its lower end.

Turning to FIGS. 4–6 in particular, the retaining sleeve 20 is preferably an integral injection molding from a suitable plastic, such as polypropylene or polyethalene, and consists of an inner annular collar 22 having four sets or grous of 1–6 trapezoidal shaped, blade-like fins 23 each whose planes are radially disposed with respect to the collar 22 and parallel to its axis. The overall diameter of the sleeve 20 is greater than that of the drain aperture 11, but that of the collar 22 is less. Owing to the nature of their material, the fins 23 are resiliently flexible in both circumferential directions, indicated by the arrows A and B in FIGS. 1, 2A, 3A, 4 and 6, relative to the collar 22. The roots of all the fins 23 begin at the lower end of the collar 22, but only the roots of each fin 1 extend the full height of the latter, their upper ends in fact preferably standing slightly proud of the upper end of the collar 22 to form noses **23*a*. The roots of the corresponding successive fins 2–6 in each group, taken in the same circumferential direction A (see FIG. 6), however, terminate at uniformly progressively greater distances from the retaining flange 13 so that the upper side edges of fins 1–6 in each group form a set of stepped-down retaining edges 23*b* which generally oppose the underface of the flange 13 and are all uniformly inclined away from the latter, an angle of about 20° between the two having proved suitable. The opposite or lower side edges of all the fins 23 of each group, on the other hand, are all uniformly distant from the retaining flange 13, are inclined toward the latter at an angle of about 45° and are transversely beveled at the same angle toward the circumferential direction B in order to provide installing edges 23*c*. Additionally, the roots of all the fins 23 are undercut at 23*d* along their vertical walls facing in the circumferential direction A in order to hinge them relative to the collar 22**.

Figure 2A:
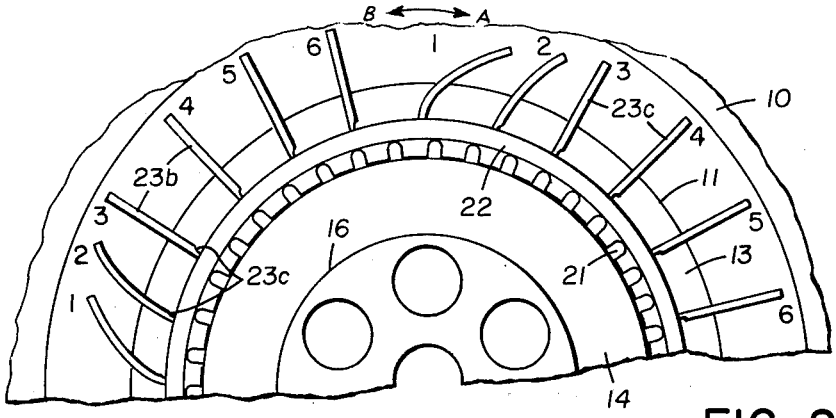
FIG. 2A is a partial bottom plan view of FIG. 2.

As previously mentioned, the parts are preassembled at the factory, and supplied as a unitary assembly for installation in the field. That is to say, the retaining sleeve 20 and locking ring 21 are in place on the drain body 12 and the seal material applied to the lower face of the retaining flange 13 and protected by a protective covering (not shown). When the drain assembly is to be installed in a sheet metal, such as stainless steel, sink, as shown in FIGS. 1, 2 and 2A, the workman simply removes the protective cover strip over the putty 18, grasps the retaining flange 13 with one hand and inserts the drain end 16 down into the drain aperture 11 until the fin installing edges **23*c* contact the latter. He then pushes down and at the same time twists the drain assembly in the circumferential direction B, whereupon the inclined and beveled edges 23*c*, assisted by the undercuts 23*d*, cause the fins 23 to flex and fold back along the collar 22 so that all the fins 23 can pass down through the drain aperture 11 until the retaining flange 13 and putty 18 seat against the sink bottom wall 10 surrounding the aperture 11. If the edges 23*c* were not inclined and beveled as described, it might, especially in the case of a sheet metal sink, be necessary to bend the fins 23 back one-by-one with the end of a screwdriver, for instance, or otherwise hold them bent back upon the collar 22, in order to get the retaining sleeve 20 down into the aperture 11. In any event, as fins 23 in each group whose retaining edges 23*b* are then below the sink bottom wall 10, for instance, fins 3–6 in FIG. 2A, will snap back to their original radial positions, but the retaining edges 23*b* of the remaining fins 23 in each group, for instance, fins 1 and 2 in FIG. 2A, since they are much closer to the retaining flange 13 and thus the sink bottom wall 10, will resiliently engage the rim of the drain aperture 11 and remain in various flexed positions as indicated in FIG. 2A. Thus the sink wall 10 is effectively clamped between the flange 13 and the retaining edges 23*b* of the two fins 23 in each group. Observe that the clamping action thereby occurs at uniformly spaced locations about the drain aperture 11**.

Figure 3:
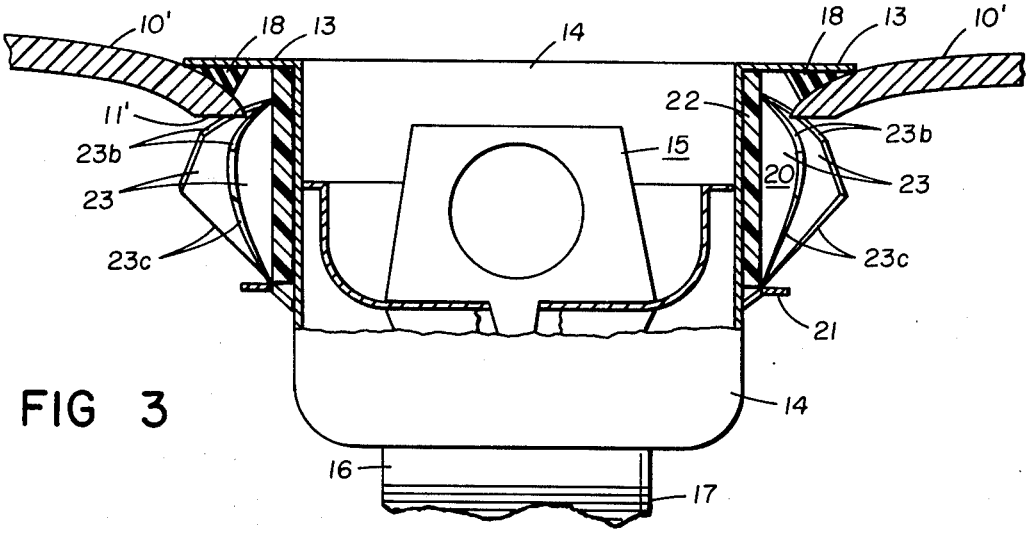
FIG. 3 is similar to FIG. 2 but illustrates installation of a drain assembly according to the present invention in a cast iron sink.
Figure 3A:
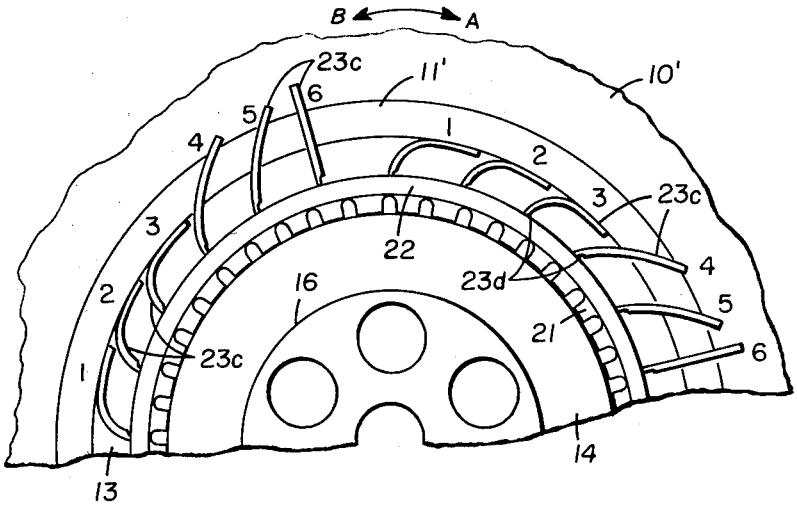
FIG. 3A is a partial bottom plan view of FIG. 3.

Installation in cast iron sinks is in an identical manner except, as shown in FIGS. 3 and 3A and owing to the thicker sink portion wall 10', more fins 23 remain in a flexed position, with, say, fins 1–3 in each group, as shown in FIG. 3A, folded completely back on the collar 22 within the aperture 11', their retaining edges **23*b* therefore being wholly out of engagement with the latter. On the other hand, fins 4–6 in each group, say, will be partially flexed with their retaining edges 23*b* in various states of engagement with the rim of the drain aperture 11', as indicated in FIG. 3A. Observe that here too the clamping action is uniformly spaced about the drain aperture 11'. More or fewer fins 23 of course could be employed in each group, depending upon the application, and the number of groups of them could also be varied so long as the resulting clamping action is uniformly distributed. In the foregoing manner, therefore, the groups of fins 23** cooperate to permit sinks of various wall thicknesses to be readily accommodated by a single drain assembly without need for any field adjustment or other means to secure it in position. And the entire operation can be performed in a few seconds by a single workman from above the sink.

It has been found in practice that a drain body 12 whose well 14 is about 2¾ inches deep and a retaining sleeve 20 which is about 1-7/16 inches in axial length will accommodate all stainless steel sinks and most all cast iron sinks. In that case the fins 23 may have a radial length of about 0.7 inches and a thickness of about 0.06 inches, with an outer diameter of the collar 22 of about 3¼ inches. The noses **23*a* of fins 1 may extend about 0.015 inches above the upper end of the collar 22 while the inner ends of the retaining edges 23*b* of fins 2–6 step down progressively therefrom, beginning with 0.028 inches for fins 2 and ending with 0.40 inches for fins 6. This assures that there will be, as is preferable, the retaining edges 23*b* of at least two fins 23 in each group in engagement with the rim of the drain aperture no matter how thin the sink bottom wall may be. While it is preferable that the retaining edges 23*b* step down in the circumferential direction opposite to that in which the drain assembly is twisted when installed, that is not mandatory, though it does insure engagement of the retaining edges 23*b* nearer their inner ends with the rim of the drain aperture and thus a better grip upon the latter. Finally, it is conceivable that the drain body 12 and the fins 23 could even be a one-piece plastic molding, thus eliminating the need for a separate collar 22 and locking ring 21**.

There are a few cast iron sinks, however, whose wall thickness is so great that they cannot be accommodated by a drain assembly of the foregoing dimensions. In those cases, the drain body well 14 would need to be deeper and a spacer used between the retaining flange 13 and the retaining sleeve 20 or a modified one of the latter employed. If a spacer were used, it would be placed between the retaining sleeve 20 and the locking ring 21 when the drain assembly were used with other sinks of thinner walls. But these very thick walled sinks are so few in number that it has not been deemed necessary to go to the expense of manufacturing and distributing additional or special parts for them. That could be done, however, and still embody the essential principles of the present invention.

Hence, though the present invention has been described in terms of a particular embodiment, being the best mode known of carrying out the invention, it is not limited to that embodiment alone. Instead, the following claims are to be read as encompassing all adaptations and modifications of the invention falling within its spirit and scope.

I claim:

1. In a drain assembly for installation in the wall of a sink or the like, the assembly including a body having an annular portion with a retaining flanged portion at one end thereof and connectable at the other body end to a drain line, the body being insertable through a sink wall from one side of an aperture therein so that the flanged portion is engageable with a first area surrounding said aperture, the improvement comprising: drain assembly retaining means located on and around the body annular portion, the retaining means including at least two sets of discrete retaining portions, the retaining portions of each set being spaced around an outer periphery of the body annular portion, each retaining portion extending generally outwardly from said periphery and being resilient and flexible relative to the body annular portion in circumferential directions about its axis, the respective retaining portions of each set thereof taken successively in one of said circumferential directions having marginal portions in opposed relation to the body flanged portion at respectively increasing distances therefrom, the retaining means being insertable together with the body annular portion through said aperture as aforesaid upon a twisting movement of the drain assembly in one of said circumferential directions, the sets of retaining portions being disposed relative to each other about said periphery so that said marginal portions of at least some of the retaining portions in each set thereof are thereupon engageable with a second area surrounding said aperture effective to sealingly clamp the sink wall between the body flanged portion and said some of the retaining portions.

2. The assembly of claim 1 wherein the retaining means comprises a collar member separate from the body annular portion but including the retaining portions, and locking means effective to locate the collar member against movement relative to the body annular portion.

3. The assembly of claim 2 wherein the locking means includes a locking member separate from the body annular portion and the collar member, the collar member and the locking member being axially removable from the body annular body portion from said other end thereof.

4. The assembly of claim 3 wherein one axial end of the collar member is disposed against the body flanged portion, and the locking member is disposed against the other axial end of the collar member.

5. The assembly of claim 2 wherein the collar member comprises a sleeve, its outer periphery having a plurality of generally planar fins integrally formed therewith constituting said assembly retaining portions, the planes of the fins being disposed generally radially with respect to the sleeve and parallel to its axis, each of the fins having first and second side edges spaced from each other axially of the sleeve, groups of successive fins constituting said sets of retaining portions, the first side edges of the fins constituting said marginal portions of the assembly retaining portions.

6. The assembly of claim 5 wherein said groups of fins are equally spaced about the outer periphery of the sleeve and the number of fine in each of said groups is equal.

7. The assembly of claim 6 wherein the first and second fin side edges are rectilinear and the distance between the body flanged portion and the first side edges of corresponding fins of each group thereof is equal.

8. The assembly of claim 7 wherein the first side edges of each of said groups of fins are uniformly inclined from the sleeve to their radially outer ends in a direction away from the body flanged portion.

9. The assembly of claim 8 wherein the second side edges of each of said groups of fins are equally spaced from the body flanged portion and uniformly inclined from the sleeve to their radially outer ends in a direction toward the body flanged portions.

10. The assembly of claim 9 wherein the second side edges of each of said groups of fins are beveled in a direction transversely of their planes and toward the other circumferential direction about the axis of the body annular portion.

11. Means for installing a drain or the like in the wall of a container, the drain or the like having an annular body with a retaining flange at an axial end thereof, the installing means comprising: a retaining assembly including a sleeve member securable on the annular body against movement relative thereto, the sleeve member being provided with a plurality of outwardly extending retaining members circumferentially spaced about its outer periphery, the retaining members being resiliently flexible relative to the sleeve member in circumferential directions of the latter and having opposite first and second margins generally opposing corresponding first and second planes at the axial ends of the sleeve member and normal to its axis, the retaining members being divided into a plurality of groups thereof uniformly disposed about the outer periphery of the sleeve member, said first margins of the retaining members in each group thereof taken successively in the same one of said circumferential directions being disposed at successively increasing distances from said first end plane.

12. The installing means of claim 11 wherein the groups of retaining members comprise equal number of generally flat blade members disposed in radial planes relative to the sleeve member and parallel to its axis, the blade members each having first and second side edges constituting said first and second margins, the distance between said first end plane of the sleeve member and said first side edges of corresponding blade members in each group thereof being equal.

13. The installing means of claim 12 wherein said first side edges of the blade members are rectilinear and uniformly slanted away from said first end plane.

14. The installing means of claim 13 wherein said second side edges of the blade members are rectilinear and equally spaced from said second end plane.

15. The installing means of claim 14 wherein said second side edges of the blade members are uniformly slanted away from said second end plane and beveled transversely of their planes toward the other of said circumferential directions.

* * * * *